US008108944B1

(12) United States Patent
Gilson, Sr. et al.

(10) Patent No.: US 8,108,944 B1
(45) Date of Patent: Feb. 7, 2012

(54) HEADWEAR APPARATUS

(76) Inventors: George Gilson, Sr., Yorkville, IL (US); George Gilson, Jr., Yorkville, IL (US)

( * ) Notice: Subject to any disclaimer, the term of this patent is extended or adjusted under 35 U.S.C. 154(b) by 494 days.

(21) Appl. No.: 12/229,213

(22) Filed: Aug. 20, 2008

Related U.S. Application Data

(60) Provisional application No. 60/965,370, filed on Aug. 20, 2007.

(51) Int. Cl.
*A61F 9/00* (2006.01)

(52) U.S. Cl. ..... 2/12; 2/209.3

(58) Field of Classification Search ..... 2/12, 15, 2/209.3; 224/918; 351/155
See application file for complete search history.

(56) References Cited

U.S. PATENT DOCUMENTS

| | | | | | |
|---|---|---|---|---|---|
| 1,599,978 | A | * | 9/1926 | Sutton | 2/209.3 |
| 1,612,750 | A | * | 12/1926 | Stake | 2/12 |
| 1,651,562 | A | * | 12/1927 | Sutton | 2/12 |
| 1,763,899 | A | | 6/1930 | McClay et al. | |
| 4,023,212 | A | | 5/1977 | Huffman | |
| 4,131,953 | A | * | 1/1979 | Kimotsuki | 2/171.1 |
| 4,578,822 | A | | 4/1986 | Schmidthaler | |
| 4,670,910 | A | | 6/1987 | Rosasco | |
| 4,768,231 | A | * | 9/1988 | Schrack | 2/13 |
| 4,896,375 | A | | 1/1990 | Colucci | |
| 5,046,195 | A | * | 9/1991 | Koritan | 2/172 |
| 5,070,545 | A | * | 12/1991 | Tapia | 40/329 |
| 5,437,064 | A | * | 8/1995 | Hamaguchi | 2/414 |
| 5,799,326 | A | | 9/1998 | Chang | |
| 5,875,493 | A | | 3/1999 | MacDonald | |
| 6,023,788 | A | * | 2/2000 | McCallum et al. | 2/209.13 |
| 6,263,515 | B1 | | 7/2001 | Turner et al. | |
| 6,442,764 | B1 | * | 9/2002 | Badillo et al. | 2/209.13 |
| 6,658,664 | B1 | | 12/2003 | Verhoeven | |
| 6,735,779 | B1 | | 5/2004 | Shrem | |
| 7,024,702 | B2 | | 4/2006 | Kronenberger | |
| 7,203,971 | B2 | | 4/2007 | Claro | |
| D559,503 | S | | 1/2008 | Melton | |
| 2004/0084495 | A1 | * | 5/2004 | Rudeen et al. | 224/668 |
| 2006/0090247 | A1 | | 5/2006 | Cho | |
| 2006/0206985 | A1 | | 9/2006 | Proctor | |
| 2007/0226879 | A1 | | 10/2007 | Pastino | |
| 2008/0047041 | A1 | | 2/2008 | Si | |

FOREIGN PATENT DOCUMENTS

| | | |
|---|---|---|
| WO | WO 99/07242 | 2/1999 |

* cited by examiner

*Primary Examiner* — Katherine Moran
(74) *Attorney, Agent, or Firm* — The Watson I.P. Group, PLC; Jovan N. Jovanovic; Vladan M. Vasiljevic

(57) ABSTRACT

A headwear apparatus comprising a base ring assembly, a support assembly and a bill. The base ring assembly has an outer surface and an inner surface. The outer surface includes a hook and loop fastener positioned therealong, and, an adjustment configuration positioned at the back region of the base ring assembly to facilitate an altering of the circumference thereof. The support assembly has a first cross strap and a second cross strap. The two cross straps intersect above the base ring assembly. The cross straps and the base ring define a hemispherical frame, and in turn, a cavity, appropriately sized to receive the head of a wearer therewithin, with a plurality of generally wedge shaped openings therebetween. The bill extends outwardly from the front region of the base ring.

14 Claims, 7 Drawing Sheets

HEADWEAR APPARATUS

CROSS-REFERENCE TO RELATED APPLICATION

The present application claims priority from U.S. Provisional Patent Application Ser. No. 60/965,370 filed Aug. 20, 2007, entitled "Strap It On Hat," the entire disclosure of which is hereby incorporated by reference in its entirety herein.

BACKGROUND OF THE DISCLOSURE

1. Field of the Disclosure

The disclosure relates in general to headwear, and more particularly, to a headwear apparatus which provides enhanced structural features and which has the ability to releasably retain accessory members (which can hold various articles).

2. Background Art

The use of headwear is known in the art. Among other forms of headwear, both baseball style hats and visors are well known. One drawback to baseball style hats is their lack of ventilation. While visors enhance ventilation, it is often times easy for a visor to become dislodged and forced downward across the face of the user. Thus, it would be advantageous to provide headwear that has the collective advantages of a baseball style hat and the visor without the drawbacks thereof.

Additionally, it is often desirable to have storage compartments, and other retaining structures in headwear. While this is desirable, in other situations, it is desirable to have no such retaining structures. Even where storage or retaining structures are desired, different sports or activities require different storage or retaining structures. Thus, it would be advantageous to provide headwear that has accessory members configured to releasably retain articles (such as golf tees, golf balls, money, coins, credit cards, etc.), while facilitating releasable attachment of the accessory members to the headgear. Thus, the user can selectively remove and replace the various accessory members.

It is an object of the present invention to provide headwear that has the collective advantages of a baseball style hat and the visor without the drawbacks thereof.

It is another object of the present invention to provide headwear that has accessory members configured to releasably retain articles.

It is another object of the invention to provide headwear that has accessory members that allow selective attachment and removal thereof from the headwear such that the accessory members can be used only when desired.

These objects as well as other objects of the present invention will become apparent in light of the present specification, claims, and drawings.

SUMMARY OF THE DISCLOSURE

The disclosure is directed to a headwear apparatus. The headwear apparatus includes a base ring assembly, a support assembly and a bill. The base ring assembly extends in a substantially circular configuration and defines a front region, a back region and opposing side regions. The base ring assembly has an outer surface and an inner surface. The outer surface includes a hook and loop fastener positioned therealong, and, an adjustment configuration positioned at the back region of the base ring assembly to facilitate an altering of the circumference of the base ring assembly. The support assembly includes a first cross strap and a second cross strap. The first cross strap extends between the opposing side surfaces in a substantially semicircular configuration above the base ring assembly. Similarly, the second cross strap extends between the front region and the back region in a substantially semicircular configuration above the base ring assembly. The first and second cross straps intersect above the base ring assembly and are coupled to each other proximate the intersection. The first and second cross straps and the base ring define a hemispherical frame, and in turn, a cavity, appropriately sized to receive the head of a wearer therewithin, with a plurality of generally wedge shaped openings therebetween. The bill extends outwardly from the front region of the base ring and includes an interfacing edge coupled to the front region of the base ring assembly and an outer edge extending from opposing outer ends of the interfacing edge. The bill is generally substantially arcuate in configuration.

In a preferred embodiment, the base ring assembly further includes an absorbent material extending along the inner surface of the base ring.

In another embodiment, the support assembly includes an arch opening strap having a first end and a second end each coupled to the back region of the base ring assembly. The arch opening strap spans the adjustment configuration and the second cross strap attaches to the arch opening strap.

In another embodiment, the front region of the base ring assembly further includes a front attachment member. The headwear further comprises a logo member having a front surface having a logo positioned thereon, and an attachment member positioned on a back surface thereof. The attachment member is configured to releasably interface with at least one of the front attachment member and a portion of the hook and loop fastener of the outer surface of the base ring assembly.

In another preferred embodiment, the headwear further comprises an accessory member. The accessory member has a base and means for attachment thereof to the hook and loop fastener of the outer surface of the base ring assembly.

In one such embodiment, the accessory member further includes at least one retaining cavity structurally configured to retain at least one object.

In another such embodiment, the at least one retaining cavity further comprises a plurality of loops positioned on the base. Each is configured to retain a golf tee.

In another such embodiment, the at least one retaining cavity further comprises a pouch having a closure member to releasably seal the cavity defined by the pouch.

Preferably, the accessory member further comprises a neck sunshade having a hook and loop fastener at a first end thereof configured to couple to the outer surface of the base ring assembly proximate the back region thereof.

In another preferred embodiment, the base ring assembly further includes a pair of longitudinal channels positioned on the outer surface. The pair of longitudinal channels are spaced apart from each other on opposite side regions of the base ring assembly. The longitudinal channels are structurally configured to releasably retain the opposing temple parts of a pair of glasses.

In another embodiment, the pair of longitudinal channels are each positioned proximate the opposing interfaces between the interfacing edge and the outer edge of the bill.

In another preferred embodiment, the first cross strap and the second cross strap are each formed from an elastic material.

In yet another preferred embodiment, a head covering is configured to substantially match the cavity formed by the support assembly and the base ring assembly. The head covering includes a base perimeter having an attachment structure that releasably interfaces with the base ring assembly. The attachment structure maintains the head covering in an attached orientation.

BRIEF DESCRIPTION OF THE DRAWINGS

The disclosure will now be described with reference to the drawings wherein.

DETAILED DESCRIPTION OF THE DISCLOSURE

Figure 1:
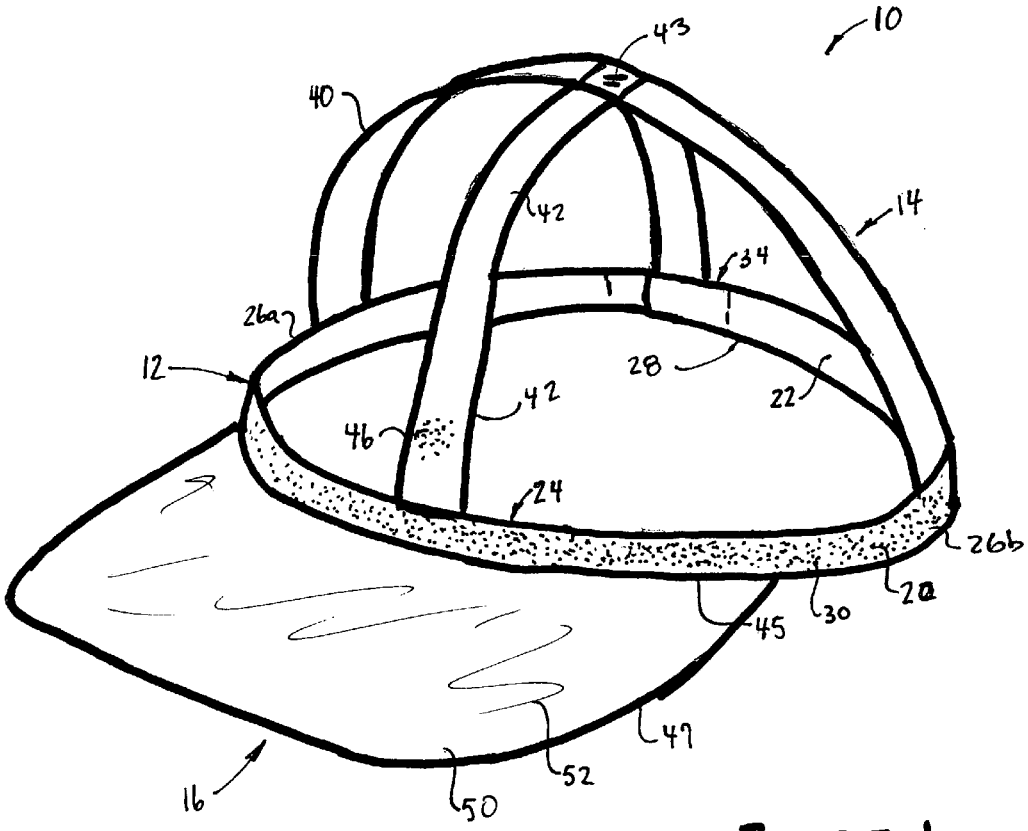
FIG. 1 of the drawings is a perspective view of one embodiment of the headwear apparatus of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
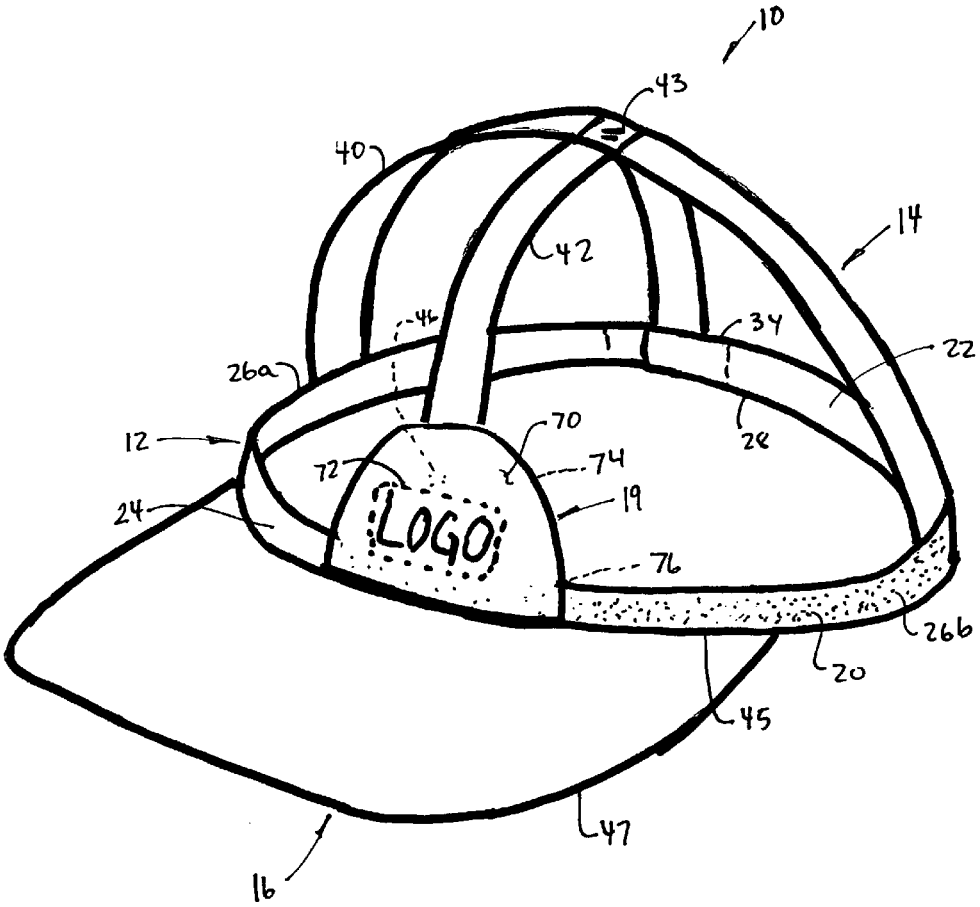
FIG. 2 of the drawings is a perspective view of an embodiment of the headwear apparatus of the present invention, showing, in particular, the use of a logo member.

Referring now to the drawings and in particular to FIG. 1, one embodiment of the headwear apparatus is shown generally at 10. The headwear includes base ring 12, support assembly 14, bill 16, accessory members, such as accessory member 18 (FIG. 4) and logo member 19 (FIG. 2). The base ring 12 includes outer surface 20, inner surface 22 and adjustment configuration 24. The outer surface 20 includes hook and loop fastener portion 30 (which may comprise the hook portion, the loop portion or a portion of each). Inasmuch as the accessory members are generally adapted to carry slightly heavier components, the hook and loop fastener portion 30 is configured to be of adequate strength to support the heavier loads. Generally, an industrial hook and loop fastener (which also may comprise a mating engagement fastener) can be utilized.

The inner surface 22 includes an absorbing medium such as a terry cloth or a high performance wicking material, among others. Generally, the base ring has a circumference that is substantially equivalent to the circumference of a typical user's head.

So that the base ring can be adjusted to substantially correspond to a user's head, the adjustment configuration 34 is provided. The adjustment configuration can comprise a break in the outer rim. With one side having one of a hook and loop fastener and the other side having the other of a hook and loop fastener. One side can overlay the other side so as to adjust the circumference of the base ring. In other embodiments, one side of the outer rim can include a series of openings and the other side can include a series of tabs that can be inserted into the openings. Of course, other adjustment configurations, such as a strip with an adjustable clamp can also be provided. In still other embodiments, the two sides can be joined to each other through an elastic band that extends between the sides.

The base ring assembly is a substantially circular configuration that can be divided into four separate regions, a front region 24, opposing side regions 26*a*, 26*b* and a back region 28. Generally, the front region corresponds to the area that is above the forehead region of a user between the temples. The sides generally correspond to the sides of a user's head and the back corresponds the back of the user's head.

Figure 3:
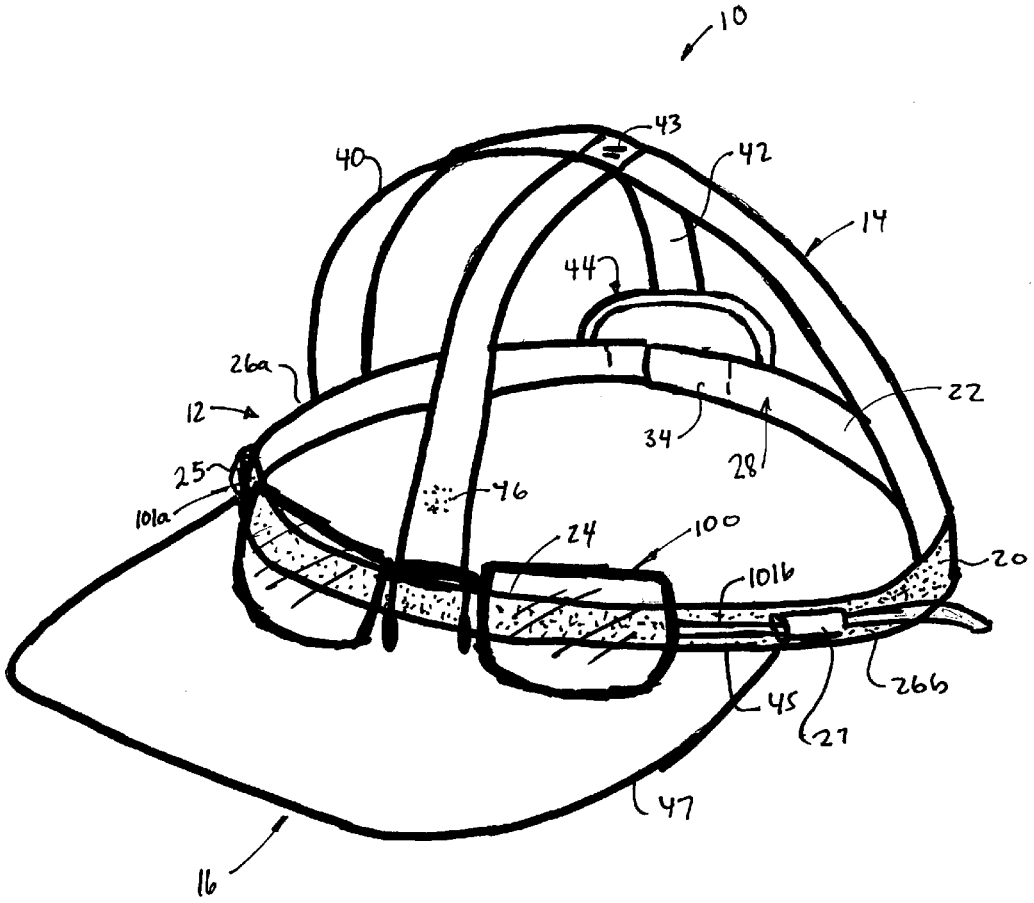
FIG. 3 of the drawings is a perspective view of an embodiment of the headwear apparatus of the present invention, showing, in particular, the use of an eyeglass holder and an arch opening strap.

With reference to FIG. 3, in certain embodiments, the base ring assembly may further include a pair of longitudinal channels 25, 27 positioned on the outer surface of the base ring assembly 12. The pair of longitudinal channels are spaced apart from each other on opposite side regions of the base ring assembly. Each of the longitudinal channels structurally configured to releasably retain the opposing temple parts 101*a*, 101*b* of a pair of glasses 100. As such, a user can insert one temple part into each of the longitudinal channels and retain the glasses in a secure position resting above the bill of the headwear. As will be described below, it is preferred that each of the pair of longitudinal channels are positioned proximate the opposing interfaces between the interfacing edge and the outer edge of the bill (i.e., at either end of the bill).

The support assembly is shown in FIGS. 1 through 3 as comprising first cross strap 40, second cross strap 42 and arch opening strap 44 (FIG. 3 only). The first cross strap 40 extends from one side region to the other side region generally from a point near one ear to a point near the other ear. The first cross strap generally comprises an elastic material, such as a spandex or an elastic band (that generally includes a rubber thread or member embedded therewithin). The second cross strap 42 extends from the front region to the back region and is coupled to the base ring assembly. Generally, the second cross strap bisects the user's forehead so that it is centrally located (although this is not required). The second cross strap is generally formed from the same elastic-like material as the first strap.

The two cross straps extend in a generally arcuate and hemispherical manner above the base ring assembly so that the three components form a cavity to receive the upper portion of a user's head. The two cross straps therefore intersect at a point that is above the central region of the base ring assembly. At the point of intersection, one of the straps extends below the strap as they intersect. The two straps are joined to each other at this point with adhesive, stitching or the like 43. In other embodiments, the cross straps may be formed from four separate pieces of material that are stitched or otherwise joined together at the point of intersection.

In the embodiment shown, the two cross straps along with the base ring assembly form four substantially identical generally wedge shaped openings. Thus, the cross straps provide support and structure to the headwear (much like a baseball cap), while allowing the ventilation and openness of, for example, a visor.

In a preferred embodiment, and with reference to FIG. 3, an arch opening strap 44 is provided at the back region 28 to interface between the second cross strap and the back region of the base ring assembly. The arch opening strap has a first end and a second end each coupled to the back region of the base ring assembly. The arch opening strap spanning the adjustment configuration 34 and the second cross strap attaches to the arch opening strap. Such a configuration essentially creates an opening above the adjustment configuration 34 that is structurally configured to allow for a user to extend a ponytail or other element therethrough. Additionally, the arch opening strap 44 provides for a structural member to which the second cross strap can be attached that does not hamper the operation of the adjustment configuration.

The bill 16 is shown in FIG. 1 as comprising core 50, upper cover 52 and lower cover (not shown). The core 50 comprises a polymer material, or a paperboard material that can maintain the desired substantially planar shape of a bill. The upper and lower covers are typically formed from an elastic material, such as a spandex. Of course other fabric materials are likewise contemplated for use, such as other textiles and woven and non-woven materials. The bill includes an interfacing edge 45 and an outer edge 47 that represent the inner and outer edges of the bill. The interfacing edge 45 interfaces with the base ring assembly about the front portion thereof. The outer edge 47 extends outwardly from the base ring assembly and forms a generally semi-circular configuration (or hemispherical configuration). The channels for receiving sunglasses are positioned at either end of the bill (i.e., proximate to the area wherein the interfacing edge and the outer edge meet).

The logo member 19 is shown in FIG. 2 as comprising a front surface 70 having a logo 72 positioned thereon, and an attachment member 76 positioned on a back surface 74 thereof. The attachment member is structurally configured to releasably interface with, for example, a front attachment member 46 positioned on the second cross member or with a portion of the hook and loop fastener of the outer surface of the base ring assembly along the front region thereof. In certain embodiments, the logo member 19 can be permanently stitched or otherwise adhered or attached to the base ring assembly and/or to the support assembly. In other embodiments (such as the embodiment of FIG. 1, the logo member can be fully eliminated).

With reference to FIGS. 4 through 8, a number of accessory members, such as accessory member 18 can be provided and coupled to the outer surface of the base ring assembly. Generally, the accessory members 18 include base 60, retaining cavity 62 and attachment means 64. Generally base 60 provides some structural integrity to the accessory member. The attachment means 64 comprises the mating hook and loop fastener to the hook and loop fastener of the base ring assembly.

Figure 4:
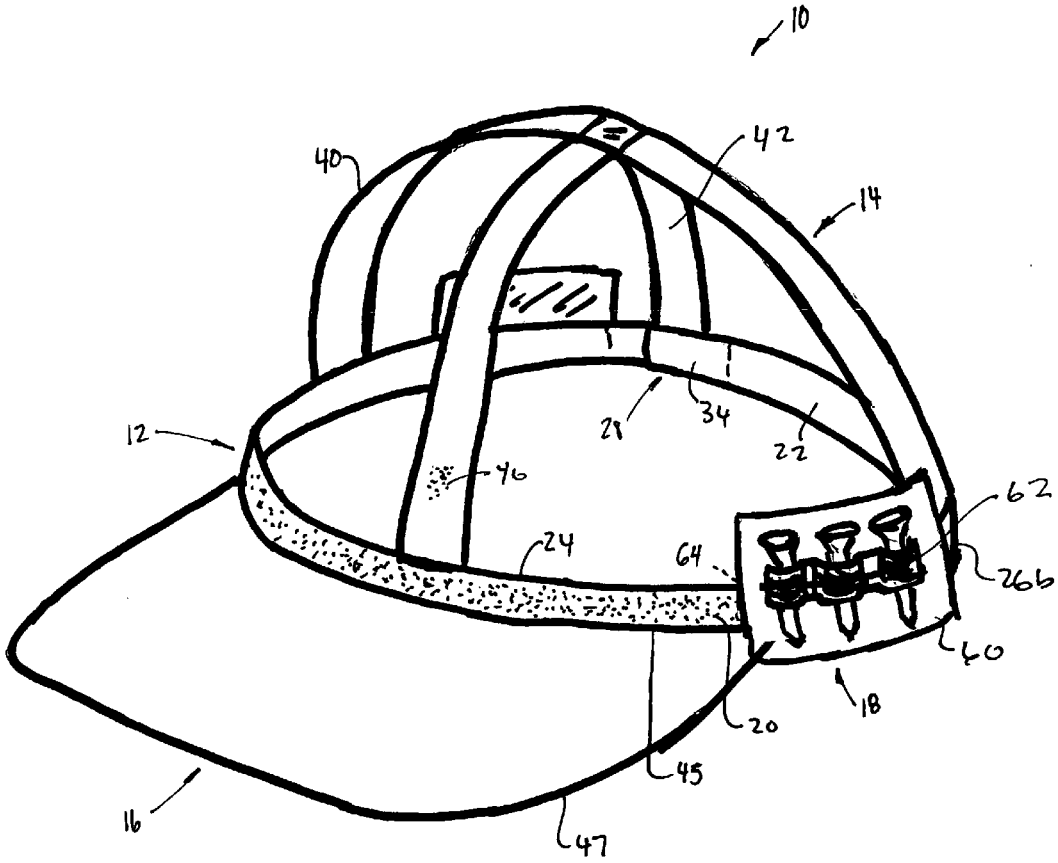
FIG. 4 of the drawings is a perspective view of an embodiment of the headwear apparatus of the present invention, showing, in particular, the use of accessory members.
Figure 6:
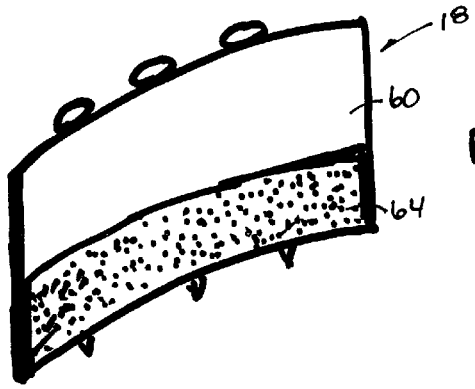
FIG. 6 of the drawings is a perspective view of an embodiment of the accessory member.
Figure 8:
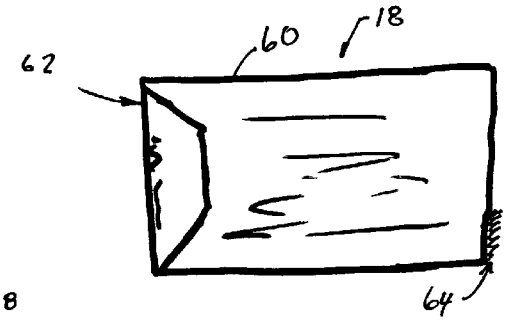
FIG. 8 of the drawings is a front plan view of an embodiment of the accessory member.
Figure 7:
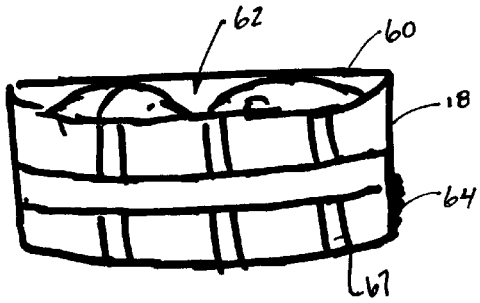
FIG. 7 of the drawings is a perspective view of an embodiment of the accessory member.

In one embodiment, shown in FIGS. 4 and 6, collectively, the retaining cavity 62 (FIG. 4 only) comprises a plurality of retaining cavities, each cavity comprising a substantially vertically facing channel. The channels are sized to retain a plurality of golf tees in a side by side orientation. In another embodiment, with reference to FIG. 7, the cavity comprises a pouch with a pair of channels positioned within the pouch and strapping bands 67. These are structurally configured to retain, for example, two golf balls. In other embodiments, with reference to FIG. 8, the retaining cavity may be configured to retain bills, coins and credit/id cards. In still other embodiments, the retaining cavity may be structurally configured to retain notepads, tools or the like. Of course, other accessory members are likewise contemplated for use.

Figure 5:
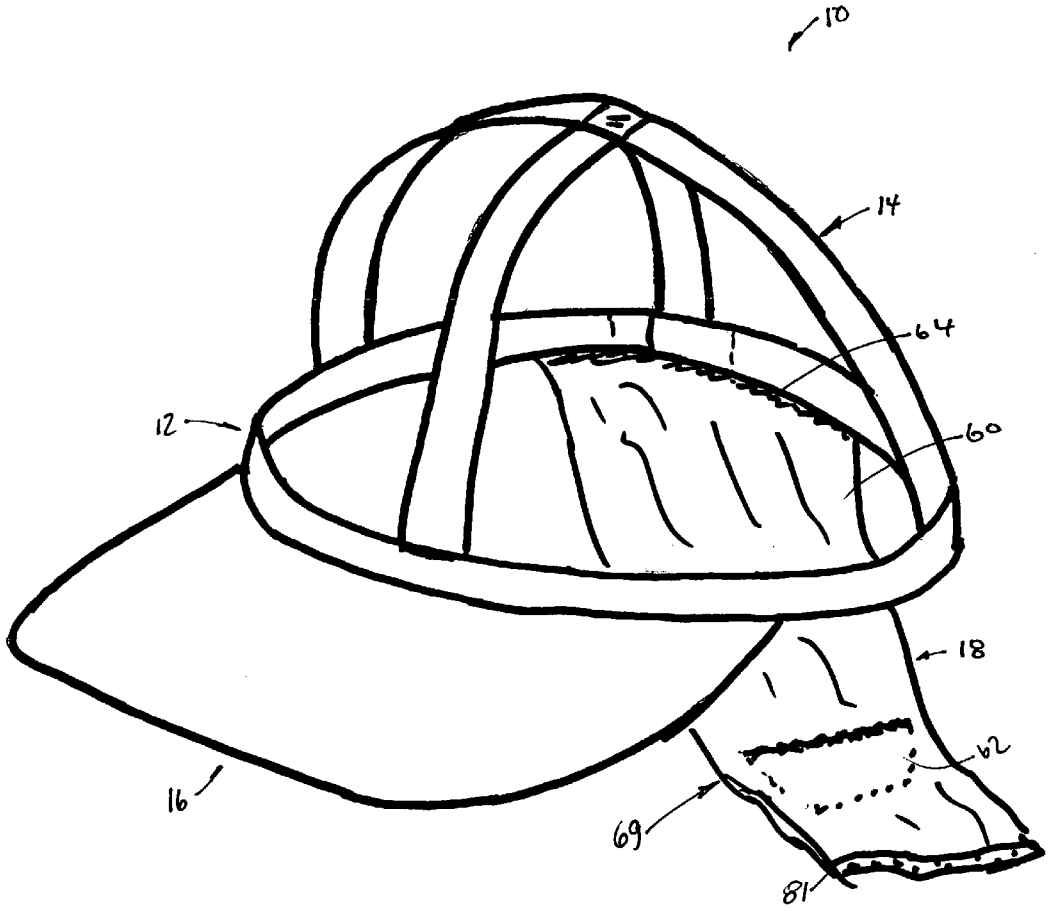
FIG. 5 of the drawings is a perspective view of an embodiment of the headwear apparatus of the present invention, showing, in particular, the use of a neck sunshade.

In one embodiment, shown in FIG. 5, the accessory member further comprises a neck sunshade 69 having a hook and loop fastener (attachment means 64) at a first end thereof configured to couple to the outer surface of the base ring assembly proximate the back region thereof. The neck sunshade further includes a retaining cavity 62 that is configured to retain structures. Additionally, stowage element 81, such as a hook and loop fastener can be provided, or a string element to facilitate rolling up the neck sunshade when not in use, and stowing the same.

In operation, the user can first adjust the base ring assembly so that it properly fits the user's head. Next, the user can select the desired accessory members that are to be attached to the outer surface of the base ring assembly. Once selected, these accessory members can be coupled to various regions of the base ring assembly as desired. They can be removed, moved around and replaced as desired. It will be understood that a single accessory member can be utilized, or a number of accessory members can be utilized.

Figure 9:
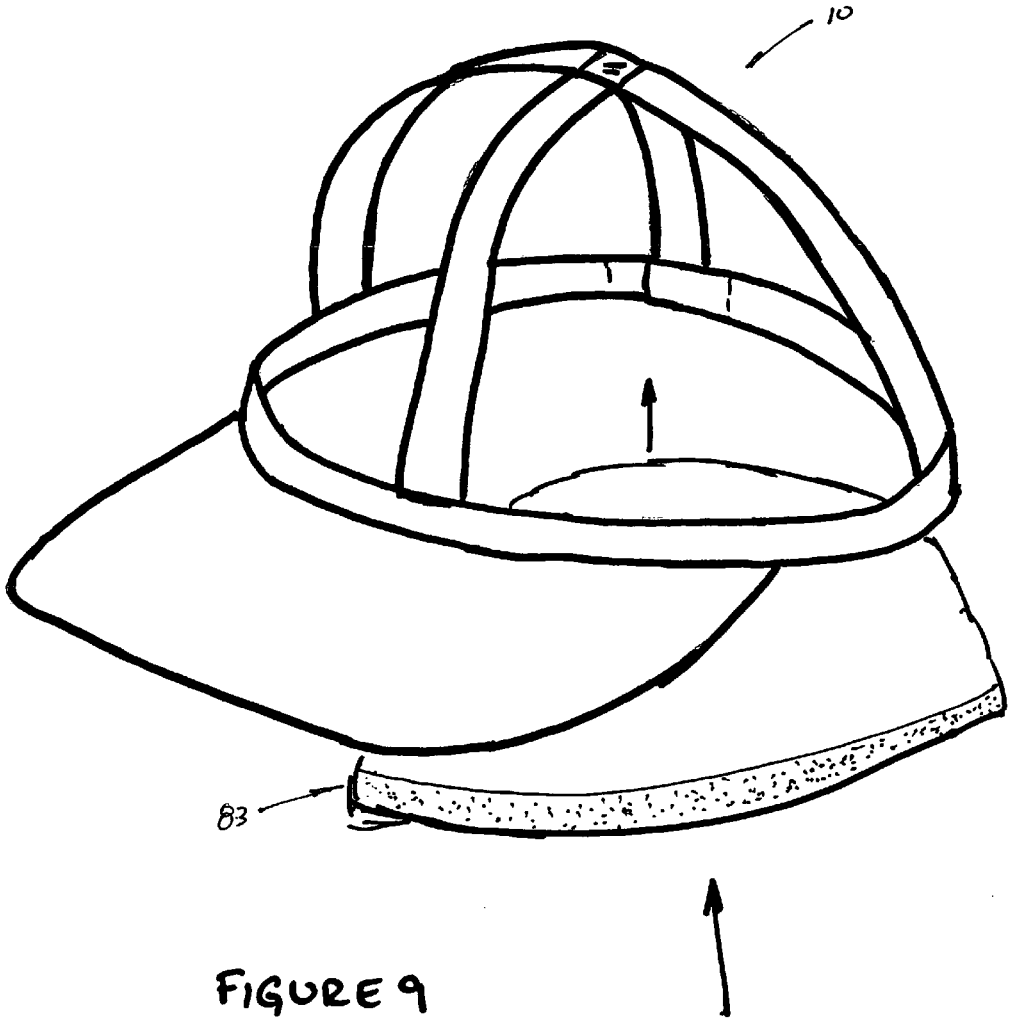
FIG. 9 of the drawings is a perspective view of an embodiment of the headwear apparatus of the present invention, showing, in particular, the use of a head covering in association therewith.

The user may also insert the temple regions of a pair of glasses into the opposing longitudinal channels to retain the glasses to the headwear above the bill. Where a user has a ponytail or longer hair, the ponytail can be extended through the area between the arch opening strap and the base ring assembly. Finally, with reference to FIG. 9, a head wrap 83 can be placed on the user's head first and the headwear can be placed over the head wrap. The two components can be joined together in a final form. In still other embodiments, a neck sunshade can be coupled to the back region of the base ring assembly.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A headwear apparatus comprising:

a base ring assembly extending in a substantially circular configuration defining a front region, a back region and opposing side regions, the base ring assembly having an outer surface and an inner surface, the outer surface including a hook and loop fastener positioned therealong, and, an adjustment configuration positioned at the back region of the base ring assembly to facilitate an altering of the circumference thereof;

a support assembly having a first cross strap and a second cross strap, the first cross strap extending between the opposing side surfaces in a substantially semicircular configuration above the base ring assembly, the second cross strap extending between the front region of the base ring assembly and the back region of the base ring assembly in a substantially semicircular configuration above the base ring assembly, the first and second cross straps intersecting above the base ring assembly and coupled to each other proximate the intersection, the first and second cross straps and the base ring assembly defining a hemispherical frame, and in turn, a cavity, appropriately sized to receive the head of a wearer therewithin, with a plurality of generally wedge shaped openings therebetween;

a bill extending outwardly from the front region of the base ring assembly and including an interfacing edge coupled to the front region of the base ring assembly and an outer edge extending from opposing outer ends of the interfacing edge and being substantially arcuate in configuration; and an accessory member, the accessory member having a substantially planar base and means for hook and loop attachment thereof to the hook and loop fastener of the outer surface of the base ring assembly, wherein the accessory member further includes at least one retaining cavity structurally configured to retain at least one object;

whereupon the at least one retaining cavity further comprises a plurality of loops positioned on the base, wherein each is configured to retain a golf tee.

2. The headwear of claim 1 wherein the base ring assembly further includes an absorbent material extending along the inner surface of the base ring.

3. The headwear of claim 1 wherein the support assembly includes an arch opening strap having a first end and a second end each coupled to the back region of the base ring assembly, the arch opening strap spanning the adjustment configuration and the second cross strap attaches to the arch opening strap.

4. The headwear of claim 1 wherein the front region of the base ring assembly further includes a front attachment member, the headwear further comprising a logo member having a front surface having a logo positioned thereon, and an attachment member positioned on a back surface thereof, the attachment member configured to releasably interface with at least one of the front attachment member and a portion of the hook and loop fastener of the outer surface of the base ring assembly.

5. The headwear of claim 1 wherein the at least one retaining cavity further comprises a pouch having a closure member to releasably seal the cavity defined by the pouch.

6. The headwear of claim 1 wherein the accessory member further comprises a neck sunshade having a hook and loop fastener at a first end thereof configured to couple to the outer surface of the base ring assembly proximate the back region thereof.

7. The headwear of claim 1 wherein the first cross strap and the second cross strap are each formed from an elastic material.

8. The headwear of claim 1 further comprising a head covering configured to substantially match the cavity formed by the support assembly and the base ring assembly, the head covering including a base perimeter having an attachment structure that releasably interfaces with the base ring assembly, to in turn, maintain the head covering in an attached orientation.

9. A headwear apparatus comprising:

a base ring assembly extending in a substantially circular configuration defining a front region, a back region and opposing side regions, the base ring assembly having an outer surface and an inner surface, the outer surface including a hook and loop fastener positioned therealong, and, an adjustment configuration positioned at the back region of the base ring assembly to facilitate an altering of the circumference thereof;

a support assembly having a first cross strap and a second cross strap, the first cross strap extending between the opposing side surfaces in a substantially semicircular configuration above the base ring assembly, the second cross strap extending between the front region and the back region in a substantially semicircular configuration above the base ring assembly, the first and second cross straps intersecting above the base ring assembly and coupled to each other proximate the intersection, the first and second cross straps and the base ring defining a hemispherical frame, and in turn, a cavity, appropriately sized to receive the head of a wearer therewithin, with a plurality of generally wedge shaped openings therebetween;

a bill extending outwardly from the front region of the base ring and including an interfacing edge coupled to the front region of the base ring assembly and an outer edge extending from opposing outer ends of the interfacing edge and being substantially arcuate in configuration; and wherein the base ring assembly further includes a pair of longitudinal channels positioned on and extending along the outer surface above the interfacing edge, the pair of longitudinal channels spaced apart from each other on opposite side regions of the base ring assembly, the longitudinal channels structurally configured to releasably retain the opposing temple parts of a pair of glasses with a remainder of the glasses being positioned on the bill.

10. The headwear of claim 9 wherein each pair of longitudinal channels are each positioned proximate the opposing interfaces between the interfacing edge and the outer edge of the bill.

11. The headwear of claim 9 wherein the support assembly includes an arch opening strap having a first end and a second end each coupled to the back region of the base ring assembly, the arch opening strap spanning the adjustment configuration and the second cross strap attaches to the arch opening strap.

12. The headwear of claim 9 wherein the front region of the base ring assembly further includes a front attachment member, the headwear further comprising a logo member having a front surface having a logo positioned thereon, and an attachment member positioned on a back surface thereof, the attachment member configured to releasably interface with at least one of the front attachment member and a portion of the hook and loop fastener of the outer surface of the base ring assembly.

13. The headwear of claim 9 wherein the first cross strap and the second cross strap are each formed from an elastic material.

14. The headwear of claim 9 further comprising a head covering configured to substantially match the cavity formed by the support assembly and the base ring assembly, the head covering including a base perimeter having an attachment structure that releasably interfaces with the base ring assembly, to in turn, maintain the head covering in an attached orientation.

* * * * *